United States Patent [19]

Miller

[11] 3,982,287

[45] Sept. 28, 1976

[54] DEVICE FOR ATTACHING A SINK RIM TO A DRAINBOARD

[76] Inventor: Howard Miller, 14316 37th Ave. NE., Seattle, Wash. 98125

[22] Filed: Mar. 21, 1975

[21] Appl. No.: 560,871

[52] U.S. Cl. ..... 4/187 A

[51] Int. Cl.[2] ..... E03C 1/33

[58] Field of Search..... 4/187 A, 166, 167, 187 R, 4/170; 74/577 SF; 292/281

[56] References Cited

UNITED STATES PATENTS

| | | | |
|---|---|---|---|
| 2,450,147 | 9/1948 | Lowry | 4/187 A |
| 2,665,430 | 1/1954 | Ross et al. | 4/187 A |
| 2,913,733 | 11/1959 | Daniels | 4/187 A |
| 3,862,580 | 1/1975 | Pulles | 74/577 SF |

*Primary Examiner*—Harry N. Haroian
*Assistant Examiner*—Stuart S. Levy
*Attorney, Agent, or Firm*—Christensen, O'Connor, Garrison & Havelka

[57] ABSTRACT

A device for attaching a sink rim, which is either integral with a sink or which is a discrete structure attached to the sink, to an aperture in a drainboard includes a rotatable member appropriately attached to the sink rim which rotatable member engages the edge surfaces of the drainboard aperture as the sink is lowered into the aperture, thereby securing the sink in the aperture. The rotatable member is mounted on a bracket that is in turn affixed to a downwardly extending flange conventionally provided on the sink rim. The rotatable member has a periphery with teeth or other edge surface engaging members thereon. The rotatable member can be generally circular in configuration and can be mounted for eccentric rotation so that its plane of rotation is generally perpendicular to the edge surface of the aperture. When the rotatable member is eccentrically mounted, the teeth will progressively move outwardly relative to the sink and sink rim as the rotatable member rotates in a first direction, causing the teeth to bite into the drainboard as the sink is lowered into the aperture. A spring-like pawl engages the teeth on the rotatable member to prevent it from rotating in the opposite direction after the sink is positioned in the aperture. The sink is thereby secured in the aperture to eliminate any possibility of retrograde movement of the sink after installation.

16 Claims, 11 Drawing Figures

Fig. 1.
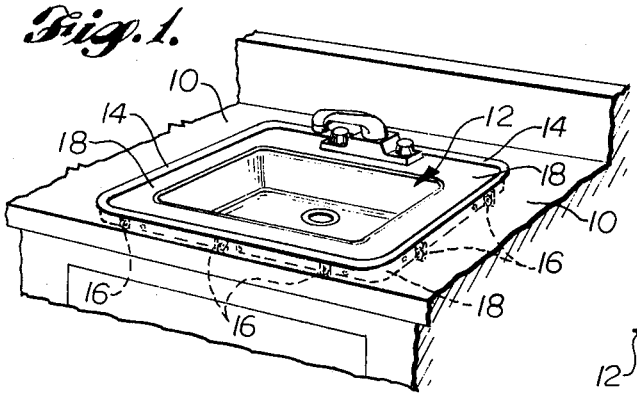
Fig. 2.
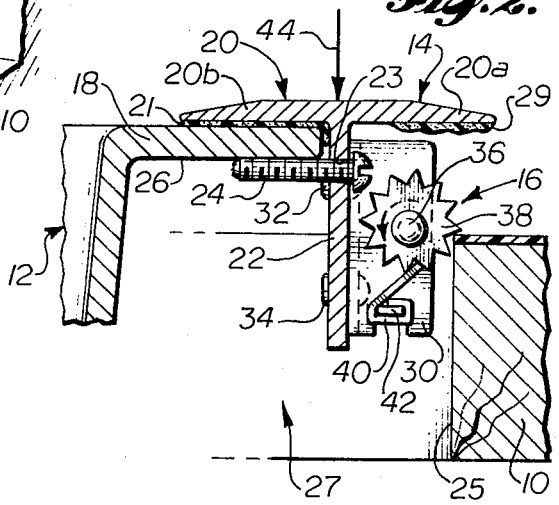
Fig. 4.
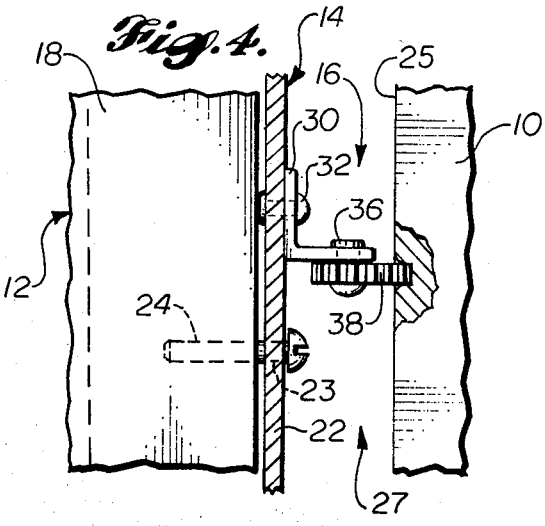
Fig. 3.
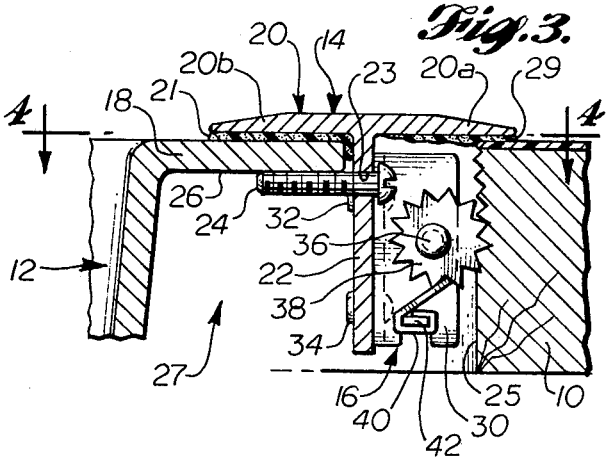
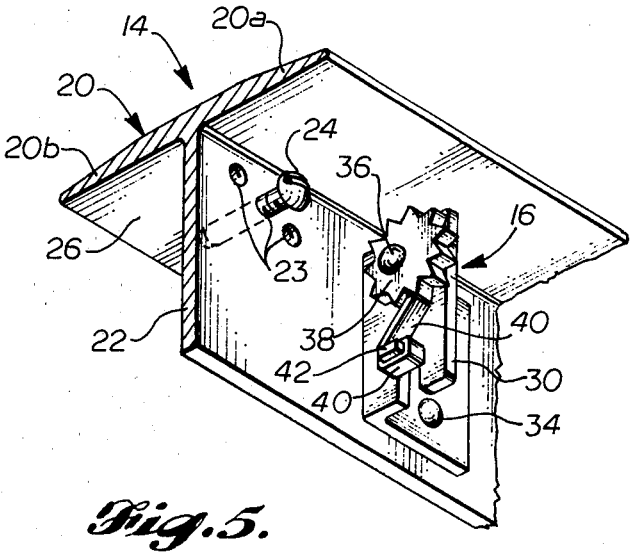
Fig. 5.
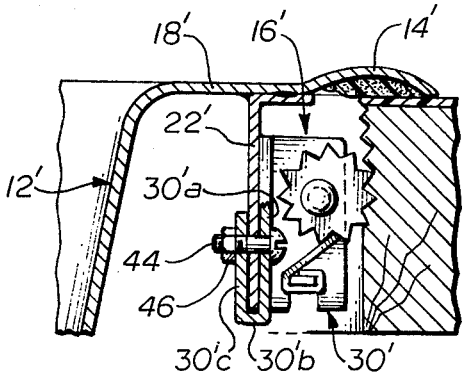
Fig. 6.

Fig. 7.
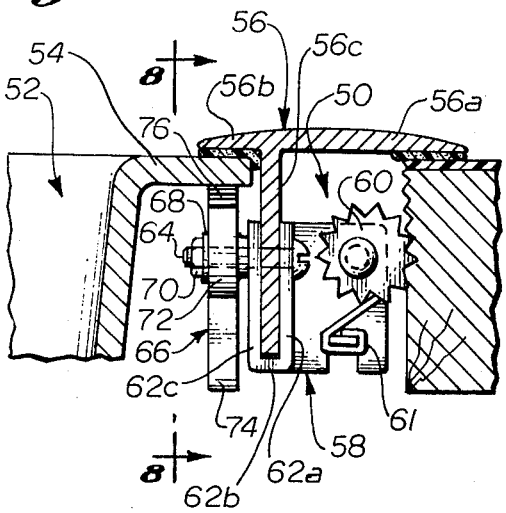
Fig. 8.
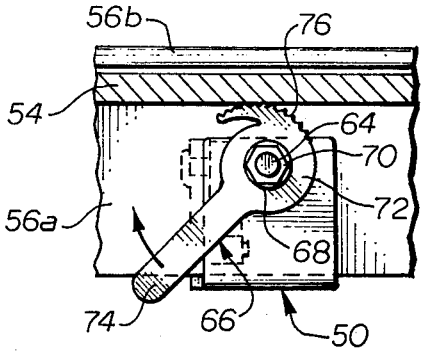
Fig. 9.
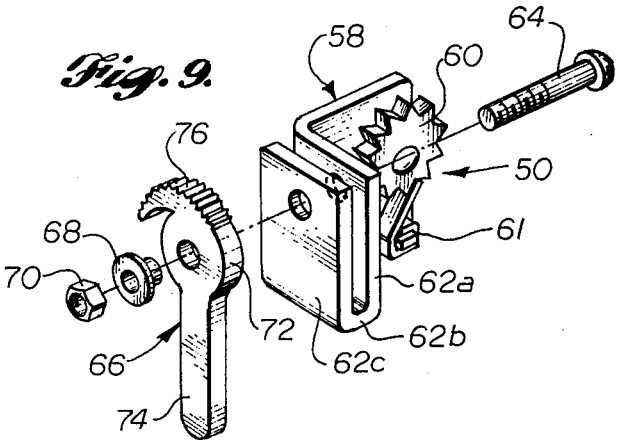
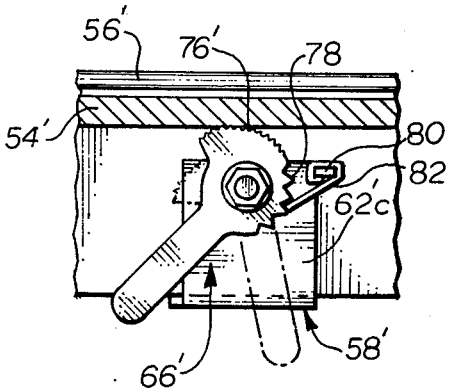
Fig. 10.
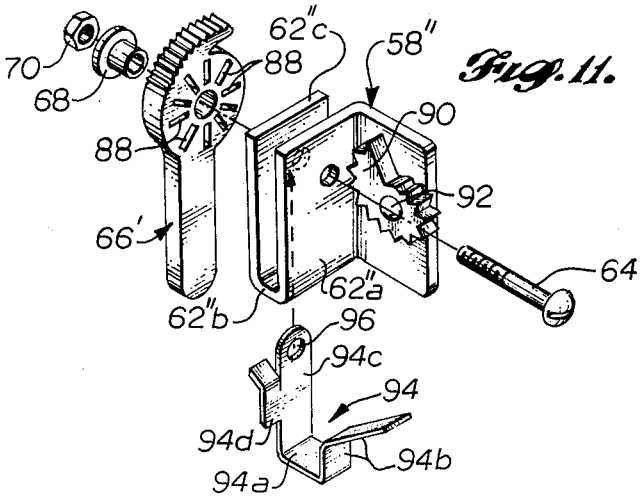
Fig. 11.

DEVICE FOR ATTACHING A SINK RIM TO A DRAINBOARD

BACKGROUND OF THE INVENTION

The present invention relates to a means for securing a sink in an aperture provided therefor in a drainboard, and more particularly, to a means for securing a sink rim to a sink and to a means for securing the sink rim and sink within the drainboard aperture.

In modern construction sinks are normally recessed in an aperture provided therefor in a drainboard or other countertop arrangement. Sinks of the type manufactured from porcelain coated steel are normally supported and secured in the aperture by using a rim, conventionally manufactured for that purpose, which serves as both a seal structure between the upper, countertop level, flange on a sink and the drainboard and which also serves as a trim member to cover the gap normally left between the edges of the aperture and the periphery of the sink flange. Although there are a great variety of rims commercially available, all such rims when installed have a common structural characteristic. This characteristic includes a generally horizontally extending flange that surrounds and overlies the outwardly extending peripheral flange on the sink and a downwardly extending flange member. The inner portion of the horizontally extending flange overlies and abuts the upper surface of the peripheral sink flange. The outer portion of the horizontally extending flange overlies and abuts the upper surface of the drainboard adjacent the drainboard aperture. The downwardly extending flange member of the sink rim extends downwardly from the bottom surface of the horizontal portion of the rim between the peripheral edge of the peripheral sink flange and the inwardly facing generally upright edge surfaces of the drainboard that define the aperture to provide an attachment member for securing the rim to both the sink and the drainboard.

Prior art devices for securing the sink rim to the sink and to the drainboard generally comprise a plurality of levers, screws and bolts that must be fastened to the sink and to the drainboard from the bottom side of the drainboard and the sink after the sink is inserted in the drainboard aperture. Additionally, with many of these devices, the sink must be held in place by a first workman as a second workman is securing the rim to the sink from the bottom. Thereafter, the second workman must secure the rim to the drainboard by various means including tightening of bolts and screws to secure the sink and sink rim in place in the aperture. This procedure is very tedious and time consuming and in addition requires the workmen installing the sink and sink rim to undergo various physical contortions in order to complete the installation.

The prior art suggests several devices that may ease the workman's task in installing a sink asembly, including devices that can be attached to the sink before the sink is inserted into its drainboard aperture. An example of such a device is a generally vertically oriented rack or racklike device that is attached to the sink rim after the rim is attached to the sink. A plurality of spring-like pawl members are mounted on the inwardly facing edge surfaces of the aperture on the drainboard. When the sink assembly, including the rack-like members mounted on the sink rim, is inserted downwardly into the aperture, the rack-like members engage the spring-like pawls, thereby securing the sink assembly in place. Such devices ease the task of installing sink assemblies, however, they require installation of additional pieces of hardward in order to employ them, i.e., the spring-like pawl members. The installation of extra or additional hardware consumes additional installation time, thereby detracting from an efficient installation procedure.

It is an object of the present invention to provide an apparatus for securing both a conventional sink and sink rim and a sink having an integral rim in an aperture in a drainboard that (a) does not require the installer to gain access to the bottom of the sink or drainboard during installation, (b) that does not require the installation of additional or extraneous hardware, (c) that is relatively simple to use, (d) that can be used with any of a variety of commerically available sink rim configurations, and (e) that secures the sink in the aperture as it is inserted into the aperture. It is a further object of the invention to provide an apparatus for securing a sink rim to a conventional type sink before the sink is positioned in a drainboard aperture, to provide such an apparatus that can be installed on the sink rim simultaneously with the apparatus for securing the assembly in the drainboard aperture.

SUMMARY OF THE INVENTION

The foregoing objects, and other objects that will become apparent to one of ordinary skill in the art after reading the following specification, are provided in an improved apparatus for securing a sink assembly having an integral or a discrete sink rim in an aperture in a drainboard. The improvement comprises a rotatable member, means for mounting the rotatable member to the sink assembly, and means for allowing the rotatable member to rotate in only one direction. The rotatable member has a periphery carrying a plurality of members that engage and bite into the edge surface defining the drainboard aperture. The rotatable member is located below the outer portion of the sink rim such that the periphery of the rotatable member is spaced inwardly from the outer peripheral edge of the sink rim. The rotatable member and the means for mounting the rotatable member to the sink rim and constructed so as to move the edge surface engaging members on the periphery of the rotatable member outwardly relative to the rim member toward the edge surface of the aperture as the rotatable member rotates in a first direction. The edge surface engaging members on the periphery of the rotatable member contact the inwardly facing edge surface of the aperture to rotate the rotatable member in the first direction as the sink assembly is inserted or lowered into the aperture. As the rotatable member rotates, the edge surface members move outwardly, thus biting into the edge surface to form a secure connection between the rotatable member and the edge surface of the aperture. Once the sink member is inserted into the aperture, the means for allowing the rotatable member to rotate in only one direction prevents reverse rotation, thereby preventing retrograde movement of the sink and sink rim upwardly relative to the drainboard.

BRIEF DESCRIPTION OF THE DRAWINGS

A better understanding of the present invention can be derived by reading the ensuing specification in conjunction with the accompanying drawings wherein:

FIG. 1 is an isometric view showing a sink and discrete sink rim installed with the apparatus of the present invention;

FIG. 2 is a cross-sectional view illustrating a portion of the peripheral flange on a conventional sink, a typical "T" shaped attachment rim member, and a first embodiment of the securing and attachment apparatus of the present invention, all about to be installed into an aperture in a drainboard;

FIG. 3 shows the sink assembly and securing and attachment apparatus fully inserted into the aperture;

FIG. 4 is a horizontal sectional view taken along section line 4—4 of FIG. 3 with the sealant material omitted;

FIG. 5 is an isometric view of a typical sink attachment rim and the securing and attachment apparatus shown in FIGS. 2 through 4;

FIG. 6 is a vertical sectional view of a sink of the stainless steel type having an integral rim, showing the use of the securing and attachment apparatus of the present invention therewith;

FIG. 7 is a vertical sectional view through a conventional sink, sink rim and drainboard showing a second embodient of the apparatus of the present invention, which includes a cam-like locking device for securing the sink rim to the generally horizontally disposed, peripheral flange of the sink;

FIG. 8 is a sectional view along section line 8—8 of FIG. 7 of the cam-like locking device of the present invention;

FIG. 9 is an exploded isometric view of the securing and attachment apparatus of the present invention including the cam-like locking device for securing the sink rim to the sink;

FIG. 10 is an alternate embodiment of the cam-like locking device showing a ratchet mechanism for preventing reverse rotation of the cam-like device once it is in a securing position; and FIG. 11 is an exploded isometric view of yet another embodiment of the present invention incorporating the second embodiment of the securing and attachment device as well as the cam-like locking device, showing a unitary spring member that serves as a pawl mechanism for both the securing and attachment apparatus and the cam-like locking device.

DESCRIPTION OF PREFERRED EMBODIMENTS

Referring first to FIG. 1, a sink 12 is conventionally recessed into an aperture provided therefore in a conventional drainboard 10 forming part of a typical bathroom or kitchen counter. Such sinks normally have a basin, the upper portion of which terminates in an outwardly extending, generally horizontally disposed, peripheral flange portion 18. The aperture cut in the drainboard 10 is usually slightly larger than the outer peripheral edge of the horizontally disposed peripheral flange 18. This is especially true of the porcelain coated, steel sinks. A sealing, trimming and sink support rim 14, referred to hereafter as a sink rim, is normally employed to cover the gap between the edges of the aperture in the drainboard 10 and the peripheral edge of the peripheral sink flange 18. The inner portion of the sink rim 14 normally overlies the upper surface of the peripheral sink flange 18. The outer, peripheral portion of the sink rim normally overlies the upper surface of the drainboard 10 adjacent the edge of the sink receiving aperture.

The sink rim 14 is attached to the sink and to the drainboard via a plurality of securing and attachment members 16. It is within this environment that one embodiment of applicant's sink rim attaching device 16 is employed. Normally, a plurality of the sink rim attaching devices 16 are disposed at spaced locations under the rim adjacent the edge of the aperture. For example, on a conventional rectangular sink, three of applicant's devices can be employed at spaced locations along each of the front and rear longitudinal dimensions of the sink and two at spaced locations along each side of the sink as shown in FIG. 1.

Referring now to FIGS. 2 through 5, a sink rim 14 of conventional construction is attached to the peripheral flange 18 on the sink 12. Generally, such sink rims have a generally "T" shaped cross section with a generally horizontally disposed, upper arm, comprising inner and outer portions 20*b* and 20*a*, respectively, and a generally vertically disposed, lower arm 22, which is integral with the horizontally disposed upper arm and which extends downwardly from the central portion of the lower surface of the horizontally disposed arm. The inner portion 20*b* of the horizontally disposed arm overlies the upper surface of the peripheral sink flange 18. A sealant material 21 is interposed between the bottom surface of the inner portion 20*b* of the horizontally disposed arm and the upper surface of the peripheral flange 18. A plurality of attachment holes 23 is conventionally provided in the vertically disposed arm 22 of the sink rim 14, each of which are spaced from the next adjacent hole in both the longitudinal dimension (the horizontal dimension) of the rim and the vertical dimension of the vertically disposed arm 22. A conventional sheet metal screw or other fastening means 24 is threadably engaged in one of the holes 23 so as to position the upper portion of the threaded end of the sheet metal screw 24 against the lower surface 26 of the peripheral sink flange 18 while the upper portion of the peripheral flange is snug against the bottom of the inner portion 20*b* of the horizontally disposed arm of the sink rim 18, thereby affixing the sink rim 14 to the peripheral sink flange 18. If the sink flange happens to be relatively thin, one of the plurality of holes 23 that is nearer in the vertical dimension to the bottom surface of the horizontally diposed arm is chosen as opposed to one of those that is spaced vertically below.

In accordance with the present invention, the sink rim attachment device 16 is affixed to the outwardly facing surface of the vertically disposed arm 22 of the sink rim 14. The attachment device includes a bracket member 30, attachment rivets 32 and 34, a toothed wheel 38, an axle 36, and a pawl mechanism 40. The bracket 30 when viewed from above is generally "L" shaped and extends from a location below the bottom surface of the outer portion 20*a* of the horizontally disposed arm of the sink rim 14 to a location above the bottom edge of the vertically disposed arm 22 of the sink rim 14. One arm of the "L" shaped bracket 30 abuts the outwardly facing surface of the vertically disposed arm 22 and contains holes that are aligned with corresponding holes in the vertically disposed arm 22 of the sink rim 14. The rivets 32 and 34 extend through these holes and secure the bracket firmly to the vertically disposed arm 22 of the sink rim 14. The second arm of the "L" shaped bracket 30 extends generally outwardly from the outer surface of the vertically disposed arm 22. The outwardly extending arm of the bracket 30 carries an axle 36 securely affixed at a location adjacent its outer, generally vertically disposed edge. The axle 36 mounts a wheel, generally designated 38, for rotation about an axis transverse to the outwardly extending arm of the bracket 30. The rotational plane of the wheel 38 is oriented generally vertically and generally parallel to the outwardly extending arm of the bracket 30, and generally perpendicularly to the inwardly facing edge surface 25 of the aperture 27 formed in the drainboard 10. In this embodiment the wheel 38 is generally circular in shape and has a plurality of teeth formed integrally in the periphery thereof. The wheel 38 is mounted for eccentric rotation on the axle 36 so that, as the wheel is rotated from a given location through at least 180° of movement, the teeth will gradually move outwardly relative to the location of the axle, and thus outwardly relative to the location of the sink rim 14 affixed to the sink 12.

A relatively simple pawl comprises a leaf spring 40 having an end that engages the teeth on the periphery of the wheel 38. The tooth engaging arm of the spring 40 is so oriented to allow the wheel 38 to rotate in only one direction, wherein the outwardly facing teeth can move upwardly relative to the sink attachment rim 14. The other end of the spring 40 is attached to the bracket 30 by a tab 42. The bottom edge of the outwardly facing arm of the bracket 30 contains two, spaced, vertical cuts that form a tab, which is bent upwardly from its cut location to form the horizontally disposed attachment tab 42 for the spring pawl 40. The other end of the spring 40 is wrapped about the tab 42 in a manner to secure the spring from rotation about the tab thereby providing a mounting tab for the spring.

Referring to FIG. 2, in the use the sink rim 14 of generally conventional construction is first affixed to the outwardly extending peripheral flange 18 on the sink 12 by means of the screw or bolt 24 inserted through the appropriate hole in the vertically disposed arm 22 of the sink rim. Thereafter a layer of sealant material 29 is spread on the downwardly facing surface of the outer portion 20*a* of the horizontally disposed arm of the sink rim 14. The sink assembly is then positioned over the aperture 27. The wheel 38 on the bracket 30 is adjusted by rotating it about its axle 36 so that the narrowest portion of the wheel 38, i.e., the portion having the minimum radius measuring from the axle, is positioned adjacent the upper edge of the inwardly facing edge surface 25 of the aperture 27. All of the wheels on the attachment devices 16 (FIG. 1) positioned at intervals around the sink assembly are likewise positioned. Thereafter, the sink assembly and attachment devices are moved downwardly generally in the direction of the arrow 44 (FIG. 2). As shown in FIG. 3, the teeth on the periphery of the eccentrically mounted wheel 38 engage the inwardly facing edge surface 25 of the drainboard 10 and, as the device is moved downwardly cause the wheel 38 to rotate. It is understood that all the wheels 38 on the plurality of attachment devices 16 are likewise rotating in the same manner as the sink assembly is lowered into the aperture. As the wheel rotates, the successive teeth on the periphery of the wheel 38 are positioned further outwardly relative to the vertically disposed arm 22 of the sink rim 14, thus causing the teeth to bite into the edge surface 25 of the drainboard aperture. As this occurs, the spring 40, forming the pawl mechanism engages successive teeth on the periphery of the wheel 38. When the sealant material 29 on the bottom surface of the outer portion 20*a* of the horizontally disposed arm of the sink rim 14 contacts in sealing engagement the upper surface of the drainboard 10 adjacent the periphery of the aperture 27, the sink is supported by the drainboard 10. Retrograde movement of the sink assembly and attachment devices is prevented since the pawl mechanism prevents the wheel 38 from reversing its direction. Thus, even though an upward force is exerted on the sink 12, the sink assembly cannot be moved back out of the aperture 27. Should it be desired for any reason to remove the sink 12 from the aperture, only the spring 40 needs to be released from the wheel 38. This can be accomplished either by holding down the tooth engaging arm of the spring 40 or by sliding the entire spring off its mounting tab 42, thus allowing the wheel 38 to rotate freely.

In another embodiment of the invention as illustrated in FIG. 6, the attachment device generally designated 16′ can be employed with sinks having an integral sealing rim 14′. Sinks of the stainless steel type are normally manufactured with such integral sealing rims 14′. Sinks with integral sealing rims are normally supplied with vertical disposed flanges or arms 22′ that are either spot welded to or stamped integrally with the stainless steel sink 12′. The flange 22′ is spaced inwardly from the periphery of the integral rim 14′. With this type of sink construction, the attachment device 16, as previously described in relation to FIGS. 2 through 5 or a second embodiment of the attachment device 16′ as shown in FIG. 6 can be employed. The only difference between the device 16′ and the previously described attachment device 16 is in the bracket member 30′. The outwardly extending arm of the bracket 30′ is substantially identical to the aforedescribed embodiment. However, the vertically disposed arm of the bracket 30′*a* that abuts the outwardly facing surface of the vertically disposed flange 22′ is manufactured with an inward and upward extension that wraps around the bottom of and extends upwardly along the inwardly facing surface of the sink flange 22′. The inward extension 30′*b* of the bracket arm 30′ is formed integrally with the bottom portion of the arm 30′*a.* The inward extension 30′*b* extends rearwardly under the bottom edge of the sink flange 22′. The upward extension 30′*c* extends upwardly along the inwardly facing surface of the sink flange 22′. The outer arm portion 30′*a* and the inner portion 30′*c* contain mutually aligned bores extending axially generally inwardly.

In use the bracket 30′ is positioned on the vertically disposed flange 22′ of the sink such that the bottom edge of the vertically disposed flange 22′ abuts the upper surface of the horizontally disposed bottom arm portion 30′*b* of the bracket 30′. Thereafter, a conventional drill or other boring device can be inserted in one of the mutually aligned bores in the brackets 30′ to bore a hole through the vertically disposed sink flange 22′. A fastening means such as the bolt 44 can be inserted through the bores in the arm portions 30′*a* and 30′*c* and the bore in the sink flange 22′ and a nut 46 can be threaded onto the bolt 44 to secure the attachment device 16′ to the vertically disposed sink flange 22′. Thereafter, the use of the attachment device 16′ is identical to the previously described embodiment. If desired, any other suitable fastening means can be employed to affix the attachment device 16′ to the vertically disposed sink flange 22′.

Referring now to FIGS. 7, 8 and 9, a second embodiment of the invention is illustrated. This embodiment, generally designated 50, is designed for use with a sink 52 of generally conventional design having an outwardly extending, generally horizontally disposed, upper, peripheral flange 54 and a sink attachment rim 56 of conventional, generally "T" shaped, cross section. As shown in FIG. 7, the sink attachment device 50 is installed so that the horizontally disposed outer arm 56*a* overlies the drainboard, securing the sink rim 56 to the sink 52 and the entire sink assembly within the drainboard aperture. An attachment bracket 58 having an outwardly extending arm for mounting an eccentrically mounted wheel 60 and pawl mechanism 61 is generally constructed and generally is used in the same manner as the previously described embodiment. The horizontally disposed arm 62 of the "L"shaped bracket 58 is constructed generally similarly to the inner arm of the embodiment described in conjunction with FIG. 6 wherein an outer arm portion 62*a* of the bracket 58 abuts the outwardly facing surface of the vertically disposed arm 56*c* of the sink rim 56. The bottom, inner, arm portion 62*b* extends inwardly under the bottom edge of the vertically disposed arm 56*c* of the sink rim 56 and has an upwardly extending, inner, arm portion 62*c* that abuts the inner face of the vertically disposed arm 56*c* of the sink rim 56. As best seen in FIGS. 7 and 9, a bolt 64 is employed to secure the inner arm 62 of the bracket 58 to vertically disposed arm 56*c* of the sink rim.

In the embodiment of FIGS. 7 through 9, a second rotatable member is positioned in accordance with the invention to rotate about an inward extension of the bolt 64 when the latter is positioned through the vertically disposed arm 56*c* of the sink rim. The second rotatable member 66 is mounted for rotation on the bushing 68 that in turn on the inward extension of the bolt 64. A nut 70 then secures the bushing 68 to the bolt 64.

The rotatable member 66 comprises a generally circular portion 72 surrounding the bushing 68. A downwardly extending arm 74 is integral with the circular portion 72. The upper periphery of the circular portion 72 has an arcuate, cam-like surface 76 bearing a plurality of upwardly projecting teeth. As viewed in FIG. 8, when the rotatable member 66 is rotated about the bushing 68 in a generally clockwise direction, the teeth on the cam-like surface 76 successively rise relative to the bolt 64 will approach the horizontally disposed inner portion 56*b* of the sink rim 56. When the rim 56 is properly positioned so that the bottom surface of the inner horizontally disposed portion 56*b* of the sink attachment rim 56 overlies the upper surface of the outwardly extending sink flange 54 on the sink 52, the rotatable member 66 is located below the bottom surface of the sink flange 54. As the second rotatable member 66 is rotated in a generally clockwise direction, as viewed in FIG. 8, the teeth on the upper cam surface 76 on the rotatable member will engage the bottom surface of the sink flange 54 to progressively tighten the sink flange 54 against the bottom surface of the horizontally disposed inner portion 56*b* of the sink rim 56, thereby securing the rim 56 to the sink flange 54.

In most cases, the teeth on the upper cam surface 76 of the second rotatable member 66 will grip the bottom surface of the outwardly extending flange 54 of the sink with sufficient frictional force to prevent retrograde or reverse rotation of the rotatable member 66. However, in certain instances where a porcelain finish is employed on the bottom surface of the outwardly extending flange 54 or where the sink is manufactured from a relatively hard material, it may be necessary to employ a ratchet member to prevent reverse rotation of the second rotatable member 66. As shown in FIG. 10, another embodiment of the second rotatable member, generally designated 66' has sink flange engaging teeth 76' and also carries on one portion of its periphery a plurality of notches 78. A tab 80 formed from a portion of the inner arm portion 62'*c* of the bracket 58' carries a pawl member formed from a leaf spring 82. One end of the spring 82 is affixed to the tab 80 while an extension of the spring 82 extends downwardly to engage the notches 78 on the one portion of the periphery of the rotatable member 66'. As the rotatable member 66' is rotated in a clockwise direction to secure the sink rim 56' to the outwardly extending sink flange 54', the arm of the pawl-like spring 82 engages successive notches 78 on the periphery of the rotatable member 66', thereby preventing reverse rotation of the second rotatable member.

Referring now to FIG. 11, still another embodiment of the present invention is illustrated. This embodiment employs a mounting bracket 58'' very similar to that described in conjunction with FIGS. 7 through 9. In this embodiment, the drainboard engaging rotatable member 90 is mounted for rotation on the bracket 58'' via a pin 92 on the outwardly extending arm of the bracket 58''. The outer periphery of the first rotatable member 90 has a cam-like shape, i.e., it has an ever increasing diameter around its 360° periphery. The outer periphery of the rotatable member 90 bears teeth for engaging the inwardly facing edge surfaces of the aperture formed in the drainboard. The bracket 58'' is mounted via bolt 64 to the vertically disposed flange (not shown) of a conventional sink rim in a manner similar to that described in conjunction with FIGS. 7 through 9. Likewise, the sink flange fastening member (or second rotatable member), generally designated 66', is mounted on a bushing 68 in turn secured to an inward extension of the mounting bolt 64. A nut 70 secures the bushing and bolt in place. The sink flange engaging rotatable member 66' bears a plurality of radially disposed notches on its outwardly facing, generally circular, surface portion. The bushing 68 is constructed so that the inner circular face portion of the flange engaging member is spaced from the inwardly facing surface of the inner arm portion 62''*c* of the bracket 58''.

In this embodiment, a single spring designated 94 is employed to function as a pawl for both the drainboard engaging rotatable member 90 and the sink flange engaging rotatable member 66'. The single spring 94 has horizontally disposed bottom portion 94*a* that when installed abuts the bottom surface of the horizontally disposed bottom portion 62''*b* of the inner arm of the bracket 58''. An upwardly and outwardly extending arm 94*b* of the spring is sufficiently long to engage the teeth 92 on the peripheral portion of the drainboard engaging rotatable member 90. An inner, generally vertically disposed arm 94*c* of the spring extends upwardly from the horizontally disposed bottom portion 94*a* of the spring and abuts the inwardly facing surface of the inner arm portion 62''*c* of the bracket 58''. The upper end of the inner arm 94*c* of the spring 94 has a hole therethrough, which is aligned with the mounting holes in arms 62''*c* and 62''*a* of the bracket 58'' when the spring 94 is positioned on the bracket 58''. Thus, when the bolt 64 is inserted through the mounting hole in the bracket 58'', it is also inserted through the hole 96 in the spring, securing the spring 94 to the bracket 58. The rearward arm 94*c* bears an integral, laterally extending, tab-like extension 94*d* having an upwardly and inwardly extending arm. The inward edge of this upwardly and inwardly extending arm is positioned to engage the radial slots of notches 88 in the sink flange engaging member 66′, thus allowing rotation in only one direction when securing the sink rim to a sink flange using the device of the present invention.

The invention as disclosed herein, achieves the objects set forth at the beginning of the specification by simplifying a sink installer's task. In addition, the sink attachment apparatus of the present invention can be effectively fitted into a drainboard aperture that is cut with a relatively large dimensional tolerance, i.e., the aperture need not be very accurately cut as the sink attachment of the present invention can be adjusted for size variances in the aperture by appropriately positioning the first rotatable members on each of the attachment devices before inserting the sink assembly into the aperture. Also, the apparatus of the present invention can be used in applications where conventional fasteners cannot be used. For example, where a drainboard aperture is cut so that the side edges of the aperture are aligned with a cabinet partition running vertically downwardly from the underside of the drainboard, no obstacle is presented to use of the apparatus of the present invention. Most prior art fasteners, however, require a horizontal bottom surface on the drainboard adjacent the aperture so that fastening members can be secured thereto. Moreover, the apparatus of the embodiments disclosed in conjunction with FIGS. 7 through 11 function to rigidify the sink attachment structure without stressing the sink rim, since any inwardly directed load exerted on the first rotatable member is transferred through the mounting bracket and bolt to the second rotatable member and into the rigid sink structure. The apparatus of the present invention is also readily adapted for use with almost all conventional sink rims, both the discrete type and the integral type, available on the open market today. And not least importantly, the sink installer's task has been simplified by reducing the number of pieces of hardware used to install sink assemblies and by allowing the entire installation to be carried on from above the drainboard.

The present invention has been described in relation to several preferred embodiments. After reading the foregoing specification, one of ordinary skill in the art will be able to make various alterations, substitutions of equivalents and other changes without departing from the scope and intent of the invention as disclosed herein. It is therefore intended that the present invention be limited only be the definition contained in the appended claims.

What is claimed is:

1. In an apparatus for attaching a sink assembly to a horizontally disposed drainboard, said drainboard having an upper surface and an aperture therein for receiving said sink, the periphery of said aperture being defined by inwardly facing, substantially vertical edge surfaces on said drainboard, said sink assembly including a sink having an upper, peripheral rim flange and including a peripheral, horizontally disposed, rim member and means operably connecting said rim member to the peripheral flange of said sink, said rim member being so constructed to overlie and engage the upper surface of said drainboard adjacent said aperture and being so constructed and associated with said sink to support the weight of said sink when said sink is inserted in said aperture, said rim member having an outer peripheral edge, said sink assembly being adapted for insertion in a downward direction into said aperture, an improvement in said apparatus for preventing upward retrograde movement of said sink assembly from said aperture once said sink assembly is inserted into said aperture, comprising:

a rotatable member and means for mounting said rotatable member to said sink assembly, said rotatable member having a periphery and a plane of rotation, the periphery of said rotatable member having members thereon for gripping and engaging the substantially vertical edge surface of the aperture in said drainboard, said rotatable member being positioned below said rim member such that the periphery of said rotatable member is spaced inwardly from the peripheral edge of said rim member and such that said plane of rotation is oriented transversely to the edge surface of the aperture in the drainboard, said edge surface engaging members being capable of contacting said edge surface of the aperture to rotate said rotatable member in a first direction as said sink assembly is inserted into said aperture, said rotatable member, including said edge surface members on the periphery thereof, and said means for mounting said rotatable member being so constructed as to move said edge surface engaging members on the periphery of said rotatable member outwardly towards said edge surface of said aperture as said rotatable member rotates, and means operatively associated with said rotatable member for preventing said rotatable member for rotating in a direction opposite to said first direction.

2. The apparatus of claim 1 wherein said horizontally disposed rim member is separable from the flange portion of said sink, said rim member having an outer portion and an inner portion, said outer portion being so constructed to overlie and engage the upper surface of said drainboard adjacent said aperture said inner portion being so constructed to overlie and engage the upper surface of the peripheral flange of said sink, said rim member including a downwardly extending flange spaced inwardly from the outer peripheral edge of said rim member, wherein said apparatus includes means for attaching said rim member to the peripheral flange of said sink, and wherein said means for mounting said rotatable member to said sink assembly mounts said rotatable member to said downwardly extending flange on said rim member.

3. The apparatus of claim 2 further comprising:

a second rotatable member and means for mounting said second rotatable member on said downwardly extending flange, said second rotatable member having a cam shaped peripheral portion having teeth thereon, said second rotatable member being positioned below said inner portion of said rim member and being oriented so as to engage the bottom surface of the peripheral flange of said sink to progressively lower said inner portion of said rim member toward said peripheral flange when said second rotatable member is rotated, to thereby affix said rim member to the peripheral flange of said sink.

4. The apparatus of claim 2 wherein said rotatable member comprises a wheel having a periphery, wherein said edge surface engaging members comprise a plurality of teeth on the periphery of said wheel, and wherein said means for mounting said rotatable member to said downwardly extending flange comprises:

a bracket member, means for affixing said bracket member to said downwardly extending flange, and an axle, said bracket member and said axle being mounted so as to orient said axle generally parallel to the edge surfaces of said aperture when said sink assembly is inserted therein.

5. The apparatus of claim 4 wherein said wheel has a generally circular periphery, said wheel being eccentrically mounted on said axle to move said teeth progressively outwardly relative to said rim as said wheel is rotated in a predetermined direction.

6. The apparatus of claim 4 wherein the periphery of said wheel has a generally cam-like periphery of progressively increasing diameter, said axle mounting said wheel for rotation such that the periphery of said wheel moves progressively outwardly relative to said sink as said wheel is rotated in a predetermined direction.

7. The apparatus of claim 4 further comprising:

pawl means mounted on said bracket member and engaging the teeth of the periphery of said wheel to prevent retrograde rotation of said rotatable member.

8. The apparatus of claim 7 wherein said pawl means comprises a leaf spring having a first end thereof affixed to said bracket and a second end thereof located so as to engage the teeth on said rotatable member.

9. The apparatus of claim 4 wherein said bracket member further comprises a first portion extending transversely from said downwardly extending flange on said rim member and extending outwardly relative to said sink, said axle being affixed to said first member, a second portion extending generally parallel to said downwardly extending flange on said rim member and extending transversely from and affixed to said first portion, said second portion having an inner surface in abutting contact with the outer surface of the downwardly extending flange of said rim member, a third portion integral with the bottom of said second portion of said bracket member, said third portion extending generally horizontally under the bottom edge of said downwardly extending flange of said rim member, and a fourth portion integral with said third portion said fourth portion extending upwardly and generally parallel to said second portion, said fourth portion having an outer surface in abutting contact with the inner surface of said downwardly extending flange of said rim member, said second and fourth portions having aligned apertures therethrough for receiving a locking pin for affixing said bracket member to said downwardly extending flange on said rim member.

10. The apparatus of claim 9 further comprising:

a second rotatable member and means for mounting said second rotatable member on said downwardly extending flange, said second rotatable member having a cam shaped peripheral portion having teeth thereon, said second rotatable member being positioned below said inner portion of said rim member and being oriented so as to engage the bottom surface of the peripheral flange of said sink to progressively lower said inner portion of said rim member toward said peripheral of said sink flange when said second rotatable member is rotated, to thereby affix said rim member to the peripheral flange of said sink.

11. The apparatus of claim 10 wherein said bracket further comprises a mounting pin positioned in said apertures and wherein said second rotatable member is mounted for rotation on said mounting pin.

12. The apparatus of claim 11 wherein said second rotatable member has spaced notches thereon, said apparatus further comprising pawl means for engaging said notches for holding said second rotatable member in a given position, said pawl means affixed to said bracket member.

13. The apparatus of claim 11 wherein said pawl means comprises a spring having one end thereof affixed to the fourth portion of said bracket member and having the other end thereof in engagement with said notches on said second rotatable member.

14. The apparatus of claim 11 wherein said second rotatable member has detents thereon spaced in a generally circular array about said mounting pin, said apparatus further comprising a unitary spring member having a first portion for engaging the teeth on said wheel and having a second portion for engaging the detents on said rotatable member, and means for attaching said unitary spring to said bracket member.

15. The apparatus of claim 14 wherein said means for attaching said spring to said bracket member comprises a flange on said spring having an aperture therethrough said aperture being oriented and located on said spring member so as to be mutually alignable with the apertures through said second and fourth portions of said bracket member said spring being affixed to said bracket member by said pin for attaching said bracket member to the downwardly extending flange on said rim member.

16. The apparatus of claim 10 wherein said rotatable member has an arm extending radially therefrom, said arm for manually rotating said second rotatable member.

* * * * *